US006027579A

United States Patent [19]

Das et al.

[11] Patent Number: 6,027,579

[45] Date of Patent: Feb. 22, 2000

[54] NON-CHROME RINSE FOR PHOSPHATE COATED FERROUS METALS

[75] Inventors: Narayan Das, Libertyville; John P. Jandrists, Chicago, both of Ill.

[73] Assignee: Coral Chemical Company, Waukegan, Ill.

[21] Appl. No.: 08/888,659

[22] Filed: Jul. 7, 1997

[51] Int. Cl.[7] ..... C23C 22/05; C23F 11/00

[52] U.S. Cl. ..... 148/256; 106/14.12; 148/247; 148/253; 148/261; 428/457; 428/469; 428/472; 428/472.3

[58] Field of Search ..... 148/256, 261, 148/247, 253; 428/457, 469, 472, 472.3; 106/14.12

[56] References Cited

U.S. PATENT DOCUMENTS

| | | | |
|---|---|---|---|
| 3,391,032 | 7/1968 | Hansen et al. | 148/256 |
| 3,695,942 | 10/1972 | Binns . | |
| 3,819,424 | 6/1974 | Russell et al. | 148/261 |
| 3,850,732 | 11/1974 | Binns . | |
| 3,966,502 | 6/1976 | Binns . | |
| 4,341,558 | 7/1982 | Yashiro et al. . | |
| 4,470,853 | 9/1984 | Das et al. . | |
| 4,828,615 | 5/1989 | Cape . | |
| 4,992,115 | 2/1991 | Ikeda . | |
| 5,026,440 | 6/1991 | Finnenthal et al. . | |
| 5,064,500 | 11/1991 | Awad . | |
| 5,294,266 | 3/1994 | Hauffe et al. . | |
| 5,397,390 | 3/1995 | Gorecki . | |
| 5,449,415 | 9/1995 | Dolan . | |
| 5,531,820 | 7/1996 | Gorecki . | |

*Primary Examiner*—Anthony Green
*Attorney, Agent, or Firm*—Fitch, Even, Tabin & Flannery

[57] ABSTRACT

The invention provides a non-chrome rinse and method for treating a phosphate conversion-coated ferrous metal substrate. The rinse comprising zirconium ions, vanadium ions, fluoride ions, and phosphate ions in a ratio and a concentration effective for providing the phosphate conversion-coated ferrous metal substrate with improved corrosion resistance.

27 Claims, No Drawings

NON-CHROME RINSE FOR PHOSPHATE COATED FERROUS METALS

This invention relates generally to rinsing and sealing phosphate containing conversion coatings on ferrous metal substrates, such as sheet steel, cold-rolled steel and other such substrates. The invention more particularly relates to improving the corrosion resistant properties of such phosphate conversion coatings and improving the adhesion of paints, inks, lacquers, siccative coatings, and other over-coatings to the conversion coated surface of the metal substrate.

It is very common in the metal finishing industry to chemically treat ferrous metal substrates to provide a iron or zinc phosphate conversion coating. These conversion coatings provide a protective function to the ferrous metal substrate and promote the adhesion of paints and inks which coat the phosphate conversion coating. It is generally believed that the phosphate conversion coating reacts with the surface of the ferrous substrate to form a coating of iron/phosphate complexes, zinc/iron/phosphate complexes, or similar such metal phosphate complexes. These conversion coatings, however, also are considered relatively porous so that it is well known that the corrosion resistance of phosphate conversion coatings may be improved by treating the coating with a sealing rinse.

Sealing rinses including chromic acid or chromate compounds are known to effectively seal phosphate conversion coating surfaces and increase both the corrosion resistance of the phosphate conversion coating and the adherence of paints, inks and other over-coatings to the substrate. It is believed that the chromic acid or chromate containing rinses provide a mixture of chromium ions in the $Cr^{+6}$ and $Cr^{+6}$ valence states which form chromate/phosphate complexes filling the porous areas of the conversion coating.

While effective, the chromic acid and chromate final rinses are environmentally objectionable as they are classified and regulated as toxic chemicals. Accordingly, the use of chromium containing final rinses requires continuous compliance with environmental regulations at very significant expense. Furthermore, the presence of such toxic chemicals in the waste products of the metal forming and treating process creates substantial difficulties and additional expenses for waste disposal.

Thus, considerable efforts have been devoted to developing effective non-chromium rinses and sealers for phosphate conversion coated ferrous metals. A number of attempts to develop such final rinses for phosphate conversion coatings include polymeric and other organic coatings, tannic acid and other acidic washes, non chromate metal ion solutions, and the use of non-metal ionic solutions. The non-metal ionic solutions include solutions of phosphates, fluorides and silicas with certain quaternary amines. The non-chromate metal ion solutions include solutions of zirconium, peroxides, molybdenum, aluminum, permanganate etc. As mentioned in Cape, U.S. Pat. No. 4,828,616, those alternatives were less effective and less desirable than chromium rinses in corrosion resistance tests and paint adhesion testing.

Moreover, some of the alternative non-chrome coating, particularly those containing organics, are water soluble and may stain or discolor the surfaces of the substrate. Once such rinses are applied to the phosphate conversion coated surfaces, the treated surfaces cannot be further contacted or rinsed without losing or very significantly reducing the benefits of the sealing rinses. As a result, many non-chrome rinses are unsuitable for applications requiring additional water rinses and handling. Other non-chrome rinses, particularly those with organics, are undesirable because they may interfere or damage the water recycling and reconditioning systems used at metal treatment plants, and may leave residues that interfere with the adherence of paints and other over-coatings.

SUMMARY OF THE INVENTION

The invention provides a non-chrome rinse, a concentrate composition from which the rinse is prepared and a method for treating a phosphate conversion coated surface of ferrous metal substrates with the application of the rinse. The rinse of the invention avoids the disadvantages of prior rinses and is suitable for a wider range of uses than other prior non-chrome rinses.

The method of the invention comprises contacting the non-chrome rinse of the invention with the phosphate conversion coated surface of a ferrous metal in an amount, and for sufficient time, effective to provide a rinsed conversion coated surface with properties superior to a phosphate conversion coated ferrous metal surface which has been rinsed under the same conditions with a rinse which consists essentially of deionized water. The conversion coated surface which has been rinsed according to the invention may be dried without further treatments, or may be rinsed again with water and then dried.

The rinse of the invention incorporates zirconium and vanadium to provide a modified phosphate conversion coating which improves the corrosion resistance and improves adhesion characteristics of the coating for paints, inks and other over-coatings relative to a deionized water rinse. The rinse comprises an aqueous blend of zirconium ions, vanadium ions, fluoride ions and phosphate ions in amounts and in a ratio which are effective to improve the corrosion resistance of a phosphate conversion coated ferrous metal substrate when the rinse of the invention is applied thereto, relative to a phosphate conversion coated ferrous metal surface which has been rinsed with a deionized water rinse under the same conditions. The improvement in corrosion resistance provided by the invention often is at least about 50% over corrosion resistance after a deionized water rinse with such improvement over a deionized water rinse being as much as 300% or more.

The source of the ions used in the rinse of the invention may include without limitation, hydrofluorozirconic acid, fluoroboric acid, phosphoric acid, as well as the salts of such acids, and ammonium meta-vanadate. The rinse typically has a pH of not more than about 6, and in an important aspect is in the range of from about 3 to 5.5, to stabilize and reduce the potential precipitation of the zirconium and phosphate ions and the other metal ions in the rinse.

In an important aspect, the rinse does not have more than about 50 ppm zirconium ions, 25 ppm vanadium ions, 100 ppm fluoride ions and 45 ppm phosphate ions. In a particularly important aspect, the rinse has from about 10 to about 30 ppm zirconium ions, from about 5 ppm to about 15 ppm vanadium ions, from about 20 ppm to about 65 ppm fluoride ions and from about 9 ppm to about 30 ppm phosphate ions.

In an important aspect the ratio of zirconium ions to vanadium ions in the concentrate and the rinse is in the range of from about 1:1 to about 2:1 and is preferably about 2:1, and the ratio of zirconium ions to fluoride ions is in the range of from about 1:1 to about 1:2, and preferably 1:2. In a very important aspect, the ratio of zirconium ions, vanadium ions, fluoride ions, and phosphate ions is about 1:0.5:2:1, respectively, in the concentrate and the rinse.

The concentrate and rinse may also include other ionic and non-ionic components to assist in the operation or maintenance of the rinse solution, such as nitrates and nitric acid for pH control and chelating agents to condition the aqueous solution. The concentrate generally is diluted with water to comprise from about 0.3 to about 1.0 percent by volume of the rinse with the pH of the diluted concentrate being adjusted to not more than about 6.

The pH and the fluoride ion concentration in the concentrate composition are balanced to stabilize the active ingredients, such as zirconium ions, vanadium ions and phosphate ions, so that the concentrate remains as a solution without substantial precipitates over an extended period of time. Generally this balance and stability is provided by a pH of about 1.5 to about 2 and a fluoride concentration in the range of from about 4000 ppm to 6500 ppm.

In one important aspect, the concentrate composition of the invention is an aqueous solution comprising approximately 2200 ppm to 4900 ppm zirconium ions, approximately 1200 ppm to 2600 ppm vanadium ions and approximately 2000 ppm to approximately 4400 ppm phosphate ions. In a very important aspect, the aqueous concentrate composition of the invention comprises approximately 6200 ppm nitrate ions, approximately 3300 ppm zirconium ions, approximately 2700 ppm fluoroborate ions, approximately 2900 ppm phosphate ions, approximately 6400 ppm fluoride ions, 1700 ppm vanadium ions, and 1250 ppm penta-sodium diethylene triamine penta acetate.

Preferably, the nitrate ions are from nitric acid or salts thereof, the zirconium ions are supplied by hydrofluorozirconic acid, the fluoroborate ions are from fluoroboric acid, the phosphate ions are from phosphoric acid and the fluoride ions are from hydrofluorozirconic acid and fluoroboric acid. Other sources for such ions may also be used.

In a very important aspect, the rinse is an aqueous solution having a pH of from about 3.8 to about 5.5 comprising 20–60 ppm nitrate ions, approximately 10–30 ppm zirconium ions, approximately 8–30 ppm fluoroborate ions, approximately 9–30 phosphate ions, approximately 19–65 ppm free fluoride ions, 5–20 ppm vanadium ions, and 4–10 ppm penta-sodium diethylene triamine penta acetate.

The phosphate conversion coated ferrous metal substrates typically are treated with the rinse of the invention by applying the rinse at ambient temperatures from 15 to 30 seconds by spraying, dipping or another such application technique, and other treatment times and approaches may be used depending on the metal substrate, conversion coating, over-coating system and rinse concentration, among other factors. The preferred treatment time is for about 20 seconds. Application of the rinse of the invention is effective to seal pore areas of the conversion to resist corrosion of said substrate and promote adhesion of paints, siccative coatings and other over-coatings of the ferrous metal substrate.

While not intending to be bound by any theory, it is believed that the zirconium and vanadium ions in the rinse of the invention form reactive complexes with the phosphate ions in the rinse. The formation of such reaction products is accelerated by the fluoride ions, which also are present is an amount effective to maintain the zirconium ions in solution without compromising the properties of the conversion coating. It is believed that these reactive complexes further react at least with the ferrous metal which has not been completely conversion coated with the phosphate conversion coating composition. This reaction fills and seals pores in the coating where bare ferrous metal is exposed.

PREFERRED EMBODIMENT OF THE INVENTION

As used herein phosphate conversion coated ferrous metal substrate means iron or zinc phosphate conversion coatings provided by iron or zinc phosphating baths. An iron phosphating baths generally include an alkali metal or ammonium dihydrogen phosphates and frequently include oxidizing agents, such as bromates and chlorates to increase the rate of coating formation. Zinc phosphating baths generally include an aqueous mixture of zinc oxide, nitric acid, phosphoric acid and oxidizing agents.

As used herein deionized water rinse means a rinse which is just deionized water without any other components which would improve the characteristics of the phosphate conversion coated surface being rinsed. Deionized water is water that may be produced by passing water through a column which removes metal cations such as calcium and magnesium, and anions such as sulfate and chloride.

In the preferred embodiment of the invention, the reactive non-chrome final rinse is prepared from a concentrate for ease of transportation and storage. The concentrate is prepared by mixing under controlled conditions a water soluble source of zirconium ions, fluoride ions, phosphate ions and vanadium ions in amounts that may be diluted to provide an effective rinse as further discussed below.

In the preferred embodiment, it is necessary to control both the pH and fluoride ion content to maintain the zirconium and vanadium in solution and in valance states to provide rinse for phosphate conversion coatings when properly diluted. Accordingly, nitric acids, sulfuric acids or other similar acids and pH-adjusting agents may be used in amounts that provide a pH in the concentrate that maintains the metal ions in solution and provides a pH of about 3 to about 5.5 in the final sealing rinse bath.

Similarly, the water source used to prepare the concentrates and the final sealing rinse may include trace metal or other ionic impurities that interfere with the proper operation of the rinse. Thus, it is preferable to incorporate stabilizing and chelating agents such as penta-sodium diethylene triamine penta acetate or other similar agents and water conditioners known to the art to reduce or eliminate and interference by such impurities with the activity of the final sealing rinse.

Any of the sources for water soluble zirconium ions, fluoride ions, phosphate ions and vanadate ions known to the art may be used to prepare the concentrate and final sealing rinse. The preferred sources are hydrofluorozirconic acid (50%), fluoroboric acid (48%), phosphoric acid and ammonium metavanadate. Other sources include the salts, halides, sulfates, oxalates and other derivatives of above acids known to the art, as well as vanadic acid and the salts, sulfates, oxalates, halides and vanadium derivatives.

The selection of the specific ion sources will depend on their commercial availability and stability in the solution at the operating pH of the rinse process. For example, the use of zirconium compounds that at the operating pH of the concentrate of final sealing rinse hydrolyze to form insoluble precipitates or react to form insoluble phosphate compositions should be avoided if the loss of the reactive components of the concentrate and rinse significantly reduce the effectiveness of the rinse solution. In addition, it may be necessary in some instances to pretreat the ion sources to render them suitably water soluble and reactive for the purpose of the invention.

It also is important to provide sufficient ionic fluoride in the concentrate and final sealing rinse to avoid precipitation and to maintain the activity of the zirconium and phosphate ions. It is believed that the same is true for the vanadium ions. It is theorized that when sufficient amounts, the fluoride ions complex with and maintain in solution the zirconium ions. It also is theorized that the fluoride ions accelerate the formation of reactive zirconium phosphate complexes which react with the surface of phosphate conversion coating to fill any pores in the conversion coating and protect any exposed metal sites from corrosion. The presence of zirconium deposits on the surface of treated phosphate conversion coatings was confirmed by the surface scan discussed below.

It is theorized that the vanadium ions similarly promote the formation of metal ion phosphates which fill the pores of the phosphate conversion coatings. It also is theorized that the presence of the vanadium in a $V^{+5}$ valence state and the presence of the zirconium in the $Z^{+4}$ valence state promotes the formation of the aforementioned zirconium complex and deposition of those complexes on the surface of the phosphate conversion coatings. At the same time, the fluoride ions are very reactive and if present in excess amounts will react with and deteriorate the phosphate conversion coating.

In one example of the concentrate of the invention, an aqueous mixture of the above components is mixed at a pH of about 1.5 to about 2 and including the following components: nitrate ions at a concentration of approximately 6200 ppm supplied from nitric acid, a zirconium ions at a concentration of approximately 3300 ppm supplied from 50% hydrofluorozirconic acid, fluoroborate ions at a concentration of approximately 2700 ppm supplied from 40% fluoroboric acid, phosphate ions at a concentration of approximately 2900 ppm supplied from 48% phosphoric acid, vanadium ions at a concentration of approximately 1742 ppm supplied from ammonium meta-vanadate, and penta-sodium diethylene triamine penta acetate (50%) at a concentration of approximately 1250 ppm.

The concentrate is preferably diluted with deionized water to about 0.3% to about 1.0% by volume for use as the sealing rinse. The resulting preferred rinse contains provides approximately 20–60 ppm nitrate ions, approximately 10–30 ppm zirconium ions, approximately 8–30 ppm fluoroborate ions, approximately 9–30 phosphate ions, approximately 19–65 ppm free fluoride ions, 5–20 ppm vanadium ions, and 4–10 ppm penta-sodium diethylene triamine penta acetate. The pH for the rinse solution preferably is maintained at about 3.8 to 5.5.

The portions of both the ionic components and the sources of those components may be varied depending on the particular metal treating operation, phosphate conversion coating and economic considerations in formulating and supplying the rinse. In formulating the concentrate and rinse, it is believed that the portions of certain of the ionic components is important to maximizing the effectiveness of the sealing rinse. The preferred formulation of concentrate and rinse provides in the rinse solution a ratio of ionic zirconium to ionic vanadium of about 2:1, the preferred ratio of ionic zirconium to fluoride is about 0.5:1 and the preferred ration of ionic zirconium to phosphate is about 1:1. Accordingly, the preferred ratios of the ionic components expressed as a ratio of zirconium ions to vanadium ions to fluoride ions to phosphate ions of about 1:0.5:2:1.

When used in the method of the invention, the sealing rinse of the invention is applied to a phosphate conversion coated ferrous substrate. The invention may be applied to any of the typically used phosphate conversion coatings including those employing chlorates, bromates, molybdates, zinc, iron, organics and other such established components as accelerators. The substrates may include any ferrous containing substrate such as cold-rolled steel, hot rolled steels, electro galvanized steel and other irons or steel products capable of treatment with phosphate conversion coatings.

Typically, the substrate is formed through a bending, stamping, forging or other such forming process and cleaned with an alkaline cleaner or other such treatment to remove oils, dirt, metal fines or other surface contaminates. The cleaned substrate is then rinsed with fresh water (preferably deionized water) and is subject to phosphate conversion coatings using a spray, a dip, a bath or other such application means. Examples of such conversion coating compositions are well known in the art and include for example treatments with iron phosphate, phosphoric acid, sodium hydroxide and an oxidizer, or zinc phosphate, phosphoric acid, nitric acid, zinc oxide and nickel carbonate. The surface of the conversion coated substrate is typically rinsed with a fresh water (preferably deionized water) rinse to remove any unreacted components of the conversion coating or any other surface contaminates.

The sealing rinse of the invention typically next is applied to the conversion coated surface of the substrate using a spray, dip, bath or other such applicator. The sealing rinse preferably is applied at ambient conditions, although the application temperatures may be increased or decreased depending on the specific operating conditions. The rinse preferably is applied at a rate permitting the exposure and coverage of the conversion coating for approximately 15 to 30 seconds. The application period, as well as the ionic concentrations of the rinse, may be increased or decreased depending on specific metal substrate, the paint or other over-coating to be applied, the expected use of the metal substrate and the type and quality of the conversion coating, among factors.

After treatment with the sealing rinse, the metal substrate is typically exposed to a final rinse with water, preferably deionized water and is dried. Alternatively, the final water rinse and drying steps may be omitted or modified to adapt the method of the invention to specific application systems and specific painting or over-coating applications. The dry substrate may then be painted, printed with inks, coated with lacquers or electrically deposited liquid or powders, or otherwise over coated. When properly applied and adapted for specific applications, the sealing rinse of the invention provides improved adhesion characteristics for the sealed phosphate conversion coating, particularly when compared to phosphate coatings subject to only water rinses.

As mentioned above, the sealing rinse, method and treated coating of the invention may be used in a variety of metal treating processes and with a variety of paint, ink and other over-coating systems. Similarly, the specific composition of the rinse and steps of the method of the invention may be adjusted for specific metals, over-coating systems, metal treating process, and economic considerations. The following examples are provided to illustrate the use and benefits of the invention and should not be considered limitations or restrictions on the invention.

EXAMPLE 1

For one aspect of the invention, a rinse concentrate was prepared with the following components which were blended in an aqueous solution. The concentration of those components generally was as follows:

| Source | Component | Concentration of Effective Component (in ppm) |
|---|---|---|
| Nitric Acid | Nitrate | about 6270 |
| Hydrofluoro-zirconic Acid (50%) | Zirconium ions | about 3316 |
| Fluoroboric Acid | Fluoroborate ions | about 2704 |
| Phosphoric Acid | Phosphate ion | about 2937 |
| Ammonium Meta-Vanadate | Vanadium ions | about 1742 |
| Penta-Sodium Diethylene Triamine Penta Acetate | Chelating agent | about 1250 |

The total free fluoride in the concentrate was about 6470 ppm (as supplied by the hydrofluorozirconic acid and the fluoroboric acid), and the concentrate was maintained at a pH of about 1 to 2.5. As mentioned above, the fluoride concentration and pH were adjusted to provide a stable blend and to minimize precipitation of the phosphates and metals.

For the further ensamples mentioned below, the concentrate was mixed with deionized water in concentrations of between 0.3% to 1.0% by volume to provide the rinse bath of the invention. Unless otherwise noted, pH of the rinse bath was adjusted with nitric acid to maintain a pH of between about 3.8 to 5.5, and less than 6. The concentration of the components in the diluted rinse bath were generally as follows:

| Source | Component | Concentration of Effective Component (in ppm) |
|---|---|---|
| Nitric Acid | Nitrate | about 19–63 |
| Hydrofluoro-zirconic Acid (50%) | Zirconium ions | about 10–33 |
| Fluoroboric Acid | Fluoroborate ions | about 8–27 |
| Phosphoric Acid | Phosphate ion | about 9–29 |
| Ammonium Meta-Vanadate | Vanadium ions | about 19–65 |
| Penta-Sodium Diethylene Triamine | Chelating agent | about 4–13 |

The rinse was applied to a number of phosphate conversion coated metal substrates, generally for about 15–30 seconds unless otherwise noted. These treated samples were typically painted or otherwise over-coated and then exposed to salt water in a salt fog or spray test as described by the ASTM standard B 117. The salt spray tests were typically run either for a set number of hours, after which the corrosion or "creepage" and loss of paint adhesion were measured and rated pursuant to ASTM standard D 1654. Alternatively, the salt spray tests were continued until a predetermined amount of measurable creep and loss of paint adhesion was detected, and the length of time required to produce that amount of creep was used to compose the effectiveness of the rinse treatments.

Generally in the salt spray test, the conversion coated, rinsed and painted panels were scribed to a depth suitable to expose the underlying ferrous metal substrate. The scribed panels were then placed in a test cabinet and exposed to a continuous fog or spray of approximately 5% sodium chloride salt with a pH in the range of about 6.5 to 7.2, and at a temperature of about 95° F. (35° C.). The panels were positioned so that the salt solution droplets ran lengthwise along the scribe.

After prescribed time elapsed, the panels were rinsed with fresh water to remove salt deposits from their surfaces. The panels were scraped per ASTM 0-1654 to remove any loose paint. The nature of any corrosion in terms of measured creepage was evaluated, as were any other evidence of paint failure or corrosion. Unless otherwise noted, paints or overcoats, rinse conditions, rinse application and the test conditions for the samples that are in each example which compared and discussed in each example below were substantially same.

EXAMPLE 2

A rinse bath was prepared from a 0.25% by volume amount of the concentrate of Example 1 and was adjusted to a pH of 4.5. This rinse bath was used to treat 15 panels of cold and hot rolled steel with a chlorate accelerated phosphate conversion coating. An additional four conversion coated panels were rinsed with tap water as a control. All of the panels were then coated with an electrostatically deposited polyester paint powder which was cured at a temperature of about 300° to 450° F. (149° to 230° C.). The panels were cooled, scribed and placed in a test cabinet and subject to the above described salt spray testing until the panels corrosion creepage (including paint failure on the samples) extended about 0.125 inches (3.17 mm) from the scribe line. The panels treated with the rinse of the invention required over 800 hours before evidencing creepage of about 0.125 inches (3.17 mm), while the tap water rinsed panels evidenced about 0.125 inches (3.17 mm) creepage at approximately 250 hours.

EXAMPLE 3

A rinse bath was prepared from a 0.3% by volume amount of the concentrate of Example 1 and was adjusted to a pH of 4.2. This rinse bath was used to treat three steel A.C.T. test panels which were zinc phosphate conversion coated. An additional three steel A.C.T. panels were rinsed with deionized water as a control. All of the panels were then coated with a high solids 0.1 paint which was cured at a temperature of about 300° to 325° F. (148° to 162° C.). The panels were cooled, scribed and placed in a test cabinet and subject to the above described salt spray testing until there was corrosion creepage (including paint failure) from the scribe line of about 0.125 inches (3.175 mm) from the scribe line. The bars treated with the rinse of the invention required over 532 hours before evidencing creepage of about 0.125 inches (3.175 mm), while the deionized water rinsed panels evidenced about 0.125 inches (3.175 mm) creepage at approximately 168 hours.

EXAMPLE 4

A rinse bath was prepared from a 0.35% by volume amount of the concentrate of Example 1 and was adjusted to a pH of 4.0. This rinse bath was used to treat six panels of cold-rolled steel and galvanized steel with an organic phosphate conversion coating. In addition, four panels were treated with a chrome sealing rinse and six additional panels were rinsed with deionized water as a control. All of the panels were then coated with an electrostatically deposited epoxy paint powder which was cured at a temperature of about 300° to 450° F. (149° to 230° C.)

The panels were cooled, scribed and placed in a test cabinet and subject to the above described salt spray testing for about 500 hours and the corrosion results were compared. The panels treated with deionized water evidenced a creep of from about 0.25 to 0.188 inches (6.35–4.78 mm). The panels treated with the chrome rinse evidenced a creep of about 0.125 (3.175 mm), and the panels treated in accordance with the invention evidence a creep of 0.063 to 0.125 inches (1.60 mm–3.175 mm).

EXAMPLE 5

A rinse bath was prepared from a 0.4% by volume amount of the concentrate of Example 1 and was adjusted to a pH of 5.5. This rinse bath was used to treat panels of cold-roll steel with a chlorate phosphate conversion coating. Additional panels were rinsed with deionized water as a control. All of the panels were then coated with an electrostatically deposited acrylic liquid paint which was cured at a temperature of about 250° to 400° F. (128° to 200° C.).

The panels were cooled, scribed and placed in a test cabinet and subject to the above described salt spray testing for about 168 hours and the corrosion results were compared. The panels treated with deionized water evidenced a creep of from about 0.25 inches (6.35 mm). The panels treated in accordance with the invention evidence a creep 0.125 inches (3.18 mm).

EXAMPLE 6

A rinse bath was prepared from a 0.35% by volume amount of the concentrate of Example 1 and was adjusted to a pH of 4.2. This rinse bath was used to treat six panels of cold-roll steel with an iron phosphate conversion coating. To determine the effect of further rinsing with deionized water, three of these treated panels were dried without further rinsing and three panels were given an additional, post-treatment wash with deionized water. An additional three iron phosphate panels were simply rinsed with deionized water and were not treated with the rinse of the invention as a control. All of the panels were then coated with a high solids oil paint which was cured at a temperature of about 300° to 325° F. (148° to 162° C.)

The panels were cooled, scribed and placed in a test cabinet and subject to the above described salt spray testing for about 250 hours and the creepage results were compared. The panels treated with deionized water evidenced a creep of from about 0.125 to 0.188 inches (3.18–4.78 mm). The panels treated in accordance with the invention and dried evidenced a creep of 0.0 to 0.063 inches (0.0–1.60 mm). The creep in the panels given a post-treatment wash with deionized water also was 0.0 to 0.063 inches (0.0–1.60 mm). This confirmed that the rinse of the invention was not significantly affected by the post-treatment water wash.

EXAMPLE 7

Several rinse baths were prepared using the amounts of by volume of the concentrate of Example 1 listed below and were adjusted to the listed pH. These rinse baths were used to treat four panels each of cold-rolled steel with a chlorate accelerated phosphate conversion coating. An additional four panels were treated with a chrome seal rinse, an additional four panels were rinsed with deionized water as a control.

All of the panels were then dried and painted with an oil based, high-solids paint which was cured at a temperature of about 300° to 325° F. (148° to 162° C.). The panels were cooled, scribed and placed in a test cabinet and subject to the above described salt spray testing for about 264 hours and then were rated for corrosion and creepage. The results of that testing are summarized below, and there was no evidence of staining or discoloration of the panels treated in accordance with the invention.

| RINSE TYPE, pH | | | CREEPAGE, IN INCHES (mm) | |
|---|---|---|---|---|
| DI Water | | | 0.5–0.625 | (12.7–15.9) |
| Chrome 0.35% | pH | 4.0 | 0.034–0.063 | (0.79–1.6) |
| Concentrate @ 0.2% by volume | pH | 4.0 | 0.125–0.188 | (3.18–4.78) |
| | | 4.5 | 0.25 | (6.35) |
| | | 5.0 | 0.25–0.313 | (6.35–7.93) |
| | | 5.5 | 0.375–0.438 | (9.53–11.13) |
| Concentrate @ 0.3% by volume | pH | 4.0 | 0.094–0.125 | (2.39–3.18) |
| | | 4.5 | 0.24–0.313 | (6.35–7.93) |
| | | 5.0 | 0.25–0.313 | (6.35–7.93) |
| | | 5.5 | 0.313–0.375 | (7.93–9.53) |
| Concentrate @ 0.4% by volume | pH | 4.0 | 0.063–0.094 | (1.59–2.39) |
| | | 4.5 | 0.25 | (6.35) |
| | | 5.0 | 0.25–0.313 | (6.35–7.93) |
| | | 5.5 | 0.313 | (7.93) |
| Concentrate @ 1.0% by volume | pH | 4.0 | 0.063–0.094 | (1.59–2.39) |

EXAMPLE 8

A rinse bath was prepared from a 0.5% by volume amount of the concentrate of Example 1 and was adjusted to a pH of 3.8. This rinse bath was used to treat one set of three panels of cold-roll steel with a chlorate accelerated phosphate conversion coating that were subject to a post-treatment wash with deionized water; one set of three panels of cold-roll steel with a chlorate accelerated phosphate conversion coating that were dried without a post-treatment water wash; and one set of three alkaline cleaned, uncoated steel panels was given a post-treatment wash with deionized water. For each sealing treatment, the panels were immersed in the sealing rinse bath, at room temperature, for about 20 seconds.

Each set of samples were given an E.S.C.A. surface scan to determine the elements and their distribution on the surface of the panels. Each of the panels treated by the sealing rinse of the invention contained elemental zirconium and phosphorus, indicating that the rinse of the invention is depositing at least zirconium on the surface of the treated samples, even with uncoated steel panels. There also was no significant difference between the amounts of zirconium present in the coatings subjected to a post-treatment deionized water wash and the panels that were dried without the wash.

EXAMPLE 9

A rinse bath was prepared from a 0.25% by volume amount of the concentrate of Example 1 and was adjusted to a pH of about 5.2. This rinse bath was used to treat two cold-roll steel panels with an iron phosphate conversion coating of 30 seconds at about 70° F. (21° C.). An additional four steel panels were rinsed with deionized water as a control. All of the panels were then coated with a T.C.I. powder paint.

The panels were scribed and placed in a test cabinet and subject to the above described salt spray testing until the panels evidence a corrosion creepage (i.e. paint failure) extended approximately 0.125 inches (3.18 mm) from the scribe line. The panels treated with the rinse of the invention required over 456 hours before evidencing creepage of about 0.125 inches (3.18 mm), while the deionized water rinsed panels evidenced about 0.125 inches (3.18 mm) creepage at approximately 144 hours.

EXAMPLE 10

A rinse bath was prepared from a 0.5% by volume amount of the concentrate of Example 1 and was adjusted to a pH of 5.0. This rinse bath was used to treat panels of cold-roll steel with a chlorate accelerated phosphate conversion coating. To determine the effect of various treatment approaches, several sets of panels were subject to various pre-painting treatments and then were coated with an electrostatically deposited liquid acrylic paint coating. One set of panels, set "A" (with six panels per set) was treated with sealing rinse bath of the invention adjusted to a pH of about 5.0 and containing an amine solvent common to such liquid acrylic paint coatings, and was dried painted. Set "B" was washed with deionized water before and after the sealing rinse treatment, dried and painted.

Set "C" was treated with the amine solvent rinse after the sealing rinse treatment and was painted without a drying step. Set "D" was treated with a permeate solvent rinse after the sealing rinse treatment and painted without drying. A set "E" was painted without a sealing rinse treatment and a last set "F" were subject to a commercially available organic, non-chrome treatment other than the sealing rinse of the invention, were dried and then painted.

The painted panels were cured at a temperature of from about 280° F. to 310° F., were cooled, were scribed and were placed in a test cabinet and subject to the above described salt spray testing for about 120 hours and the corrosion creepage results were compared. The results were as follows:

| Set | Creep in Inches (mm) |
|---|---|
| A | about 0.031–0.063 (0.79–1.60) |
| B | about 0.031–0.063 (0.79–1.60) |
| C | about 0.063 (1.60), with major paint failures in field |
| D | 0.031–0.063 (0.79–1.60) |
| E | Massive paint failures DI rinse |
| F | 0.063 (1.60) |

These results demonstrated the advantages of the rinse of the invention in a variety of applications and with several different types of pre- and post-treatments when compared to deionized water and other commercial sealing rinses.

EXAMPLE 11

Two rinse baths was prepared from the concentrate of Example 1 and each rinse bath was used to treat a set of three cold-steel panels with a zinc phosphate conversion coating. The first bath contained about 0.3% by volume of the concentrate and the second rinse bath contained about 1.0% by volume of the concentrate. Both rinse baths were adjusted to a pH of about 4.5. An additional set of three steel panels were rinsed with deionized water as a control. All of the panels were coated with a high-solid oil paint which was cured at a temperature of about 300° to 325° F. (148° to 162° C.). The panels were cooled, scribed and placed in a test cabinet and subject to the above described salt spray testing until the corrosion creepage on the panel extended approximately 0.25 inches (6.35 mm) from the scribe line. The panels treated with the first rinse with 0.3% of the concentrate required over 480 hours before reaching 0.25 inch (6.35 mm) creepage. The panels treated with the rinse containing 1.0% of the concentrate of the invention required over 600 to reach that amount of creepage. The deionized water rinsed panels evidenced about 0.25 inches (6.35 mm) creepage after approximately 120 hours.

EXAMPLE 12

A rinse bath was prepared from a 0.5% by volume amount of the concentrate of Example 1 and was adjusted to a pH of 4.0. This rinse bath was used to treat three panels of cold-roll steel with a zinc phosphate conversion coating. The performance of these panels in a salt spray test was compared with the performance of three similar zinc phosphate conversion coated, cold-roll steel panels treated with a 0.35% chrome rinse and three zinc phosphate conversion coated, cold-roll steel panels rinsed only with deionized water. All of the panels were then coated with an electrostatically applied, liquid acrylic primer and then a high solids solvent based, oil topcoat paint. The paint coatings were cured at temperatures of about 280° to 350° F. (140° to 180° C.).

The panels were cooled, scribed and placed in a test cabinet and subject to the above described salt spray testing for about 500 hours and the corrosion results were compared. The panels treated in accordance with the invention were measured with a creep of 0.125 inches (3.175 mm). The creep in the chrome rinsed panels was about 0.063 to 0.125 inches (1.60 mm to 3.175 mm). The creep in the deionized water rinse only panels was about 0.188 to 0.25 inches (4.78 mm to 6.35 mm).

The above examples should not be considered limitations on the invention and are only provided to illustrate certain of the advantages and benefits of the invention. They demonstrate and confirm the advantages of the sealing rinse of the invention over deionized water rinses, as well as other types of non-chrome rinses. The examples further illustrate the utility of the rinse of the invention in a variety of applications. Thus, the invention provides an effective and practical alternative to the less desirable chrome rinses and to non-chrome rinse systems that are not as efficient as that of the invention.

The following is claimed:

1. An aqueous rinse for a phosphate conversion coated ferrous metal substrate, the rinse having a pH of between about 3.8 and about 6 and comprising zirconium ions, vanadium ions, fluoride ions and phosphate ions; the fluoride ions in a concentration effective to prevent the precipitation of the zirconium ions without deteriorating the phosphate conversion coating; and the ratio and concentration of the zirconium ions, vanadium ions, fluoride ions and phosphate ions effective for providing the phosphate conversion coated ferrous metal substrate with an improved corrosion resistance relative to a phosphate conversion coated metal substrate which has been rinsed with deionized water.

2. An aqueous rinse as recited in claim 1 wherein the ratio of zirconium to vanadium ions is in the range of from about 2 to about 1.

3. An aqueous rinse as recited in claim 1 wherein the ratio of zirconium ions to fluoride ions is in the range of from about 1 to about 2.

4. An aqueous rinse as recited in claims 1, 2, or 3 wherein concentration of zirconium ions is not more than 50 ppm, the concentration of vanadium ions is not more than 25 ppm, the concentration of fluoride ions is not more than 100 ppm, and the concentration of phosphate ions is not more than 45 ppm, and the pH of the rinse is in the range from about 3.8 to about 5.5.

5. An aqueous rinse as recited in claim 4 wherein the ratio of zirconium ions to vanadium ions to fluoride ions to phosphate ions is about 1 to about 0.5 to about 2 to about 1.

6. An aqueous rinse as recited in claim 3 wherein the pH of the rinse is from about 3.8 to about 5.5 and the ratio of zirconium ions to vanadium ions is about 2:1.

7. An aqueous rinse as recited in claim 1 wherein the concentration of zirconium ions is in the range of from about 10 ppm to about 30 ppm, the concentration of vanadium ions is in the range of from about 5 ppm to about 15 ppm, the concentration of fluoride ions is in the range of from about 20 ppm to about 65 ppm and the concentration of phosphate ions is in the range of from about 9 ppm to about 30 ppm.

8. An aqueous rinse as recited in claim 7 wherein the pH of the rinse is from about 3.8 to about 5.5.

9. An aqueous rinse for a phosphate conversion coated ferrous metal substrate comprising from about 10 to about 30 ppm zirconium ions, from about 5 to about 15 ppm vanadium ions, from about 20 to about 65 ppm fluoride ions and from about 9 to about 30 ppm phosphate ions, the rinse having a pH in the range of about 3.8 to about 5.5.

10. An aqueous rinse as recited in claim 9 wherein the rinse further comprises from about 20 to about 60 ppm nitrate ions.

11. An aqueous rinse as recited in claim 10 wherein the rinse further comprises from about 8 to about 30 ppm fluoroborate ions.

12. An aqueous rinse as recited in claims 10 or 11 wherein the rinse further comprises from about 4 to about 10 ppm pentasodium diethylene triamine penta acetate.

13. An aqueous rinse as recited in claims 9, 10 or 11 wherein the ratio of zirconium ions to vanadium ions is about 2 to about 1.

14. The rinse of claim 9 wherein the concentration of said ions is selected to provide a ratio of zirconium ions to vanadium ions to fluoride ions to phosphate ions of about 1:0.5:0.2:1.

15. A concentrate which when diluted provides a rinse for treating a phosphate conversion coated ferrous metal substrate comprising an aqueous mixture of zirconium ions, vanadium ions, fluoride ions and phosphate ions, in a ratio and concentration effective for providing the phosphate conversion coated ferrous metal substrate with an improved corrosion resistance relative to a phosphate conversion coated metal substrate which has been rinsed with deionized water when the rinse contains at least about 0.2% by volume of said concentrate and the pH for said rinse being not more than about 6, the pH and the fluoride concentration in the concentrate being balanced to stabilize the zirconium ions, vanadium ions and phosphate ions to remain in solution in the concentrate.

16. A concentrate as recited in claim 15 wherein the pH of the concentrate is about 1.5 to about 2 and the concentration of the fluoride ions is in the range of from about 4000 ppm to about 6500 ppm.

17. A concentrate as recited in claim 16 wherein the concentration of zirconium ions is from about 2200 ppm to about 4900 ppm, the concentration of vanadium ions is from about 1200 ppm to about 2600 ppm, the concentration of phosphate ions is from about 2000 ppm to about 4400 ppm.

18. A concentrate as recited in claims 15, 16, or 17 wherein the ratio of zirconium ions to vanadium ions is in the range from about 4:1 to about 1:1.

19. A concentrate as recited in claim 17 wherein the ratio of zirconium ions to vanadium ions is about 2:1.

20. A ferrous metal substrate that has been coated with a phosphate conversion coating and then treated with an aqueous sealing rinse having a pH of between about 3.8 and about 6 and comprising zirconium ions, vanadium ions, fluoride ions and phosphate ions; said phosphate conversion coating contacted by said rinse comprising complexes of phosphates with zirconium in an amount effective to provide the phosphate conversion coated substrate with an improved corrosion resistance relative to a phosphate conversion coated metal substrate which has been rinsed with deionized water and effective to promote adhesion of paints, siccative over-coatings and non-siccative over-coatings to said phosphate conversion coating and substrate.

21. A ferrous metal substrate coated with a phosphate conversion coating; the coating having an outer surface, at least a portion of said coatings outer surface treated with the rinse of claim 1 and comprising complexes of phosphates with zirconium in an amount effective to improve the corrosion resistance of said conversion coating and promote adhesion of paints and over-coatings to said substrate and said conversion coating.

22. A method for treating a ferrous metal substrate having a phosphate conversion coating to improve the corrosion resistance of said phosphate conversion coating and the adhesion of paints and over-coatings to said substrate and said conversion coating, the method comprising applying the rinse of claim 1 to the phosphate conversion coating of the ferrous metal substrate.

23. A method for treating a ferrous metal substrate having a phosphate conversion coating to improve the corrosion resistance of said phosphate conversion coating and the adhesion of paints and over-coatings to said substrate and said phosphate conversion coating, the method comprising applying the rinse of claim 4 to the phosphate conversion coating of the ferrous metal substrate.

24. A method for treating a ferrous metal substrate having a phosphate conversion coating to improve the corrosion resistance of said phosphate conversion coating and the adhesion of paints and over-coatings to said substrate and said phosphate conversion coating, the method comprising applying the rinse of claim 7 to the phosphate conversion coating of the ferrous metal substrate.

25. A method for treating a ferrous metal substrate having a phosphate conversion coating to improve the corrosion resistance of said phosphate conversion coating and the adhesion of paints and over-coatings to said substrate and said phosphate conversion coating, the method comprising applying the rinse of claim 8 to the phosphate conversion coating of the ferrous metal substrate.

26. An aqueous rinse for a phosphate conversion coated ferrous metal substrate, the rinse having a pH of between about 3.8 and about 6 and comprising zirconium ions, vanadium ions, fluoride ions and phosphate ions; the fluoride ions in a concentration effective to prevent the precipitation of the zirconium ions without deteriorating the phosphate conversion coating; and the ratio and concentration of the zirconium ions, vanadium ions, fluoride ions and phosphate ions effective for providing the phosphate conversion coated ferrous metal substrate with an improved corrosion resistance relative to a phosphate conversion coated metal substrate which has been rinsed with deionized water, the ratio of zirconium to vanadium ions being in the range of from about 2 to about 1, and the ratio of zirconium ions to fluoride ions being in the range of from about 1 to about 2.

27. A method for treating a ferrous metal substrate having a phosphate conversion coating to improve the corrosion resistance of said phosphate conversion coating and the adhesion of paints and other over-coatings to said substrate and said phosphate conversion coating, the method comprising applying the rinse of claim 26 to the phosphate conversion coating of the ferrous metal substrate.

* * * * *